US010401022B2

(12) United States Patent
Ramond et al.

(10) Patent No.: US 10,401,022 B2
(45) Date of Patent: Sep. 3, 2019

(54) MOLTEN SALT ONCE-THROUGH STEAM GENERATOR

(71) Applicant: General Electric Technology GmbH, Baden (CH)

(72) Inventors: Mathieu Ramond, Belfort (FR); Adele Forgeot, Belfort (FR); Nils Ahlbrink, Belfort (FR); Bertrand Burcker, Belfort (FR)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 0 days.

(21) Appl. No.: 15/566,425

(22) PCT Filed: Apr. 15, 2016

(86) PCT No.: PCT/EP2016/058462

§ 371 (c)(1),
(2) Date: Oct. 13, 2017

(87) PCT Pub. No.: WO2016/169868

PCT Pub. Date: Oct. 27, 2016

(65) Prior Publication Data

US 2018/0100647 A1 Apr. 12, 2018

(30) Foreign Application Priority Data

Apr. 21, 2015 (EP) ..... 15290109

(51) Int. Cl.
*F22B 1/00* (2006.01)
*F22B 35/10* (2006.01)

(52) U.S. Cl.
CPC ..... *F22B 1/006* (2013.01); *F22B 35/10* (2013.01)

(58) Field of Classification Search
CPC ..... F22B 1/006; F22B 35/10
See application file for complete search history.

(56) References Cited

U.S. PATENT DOCUMENTS 3,097,630 A * 7/1963 Kinyon ..... F22B 1/063 122/34
3,557,760 A * 1/1971 Romanos ..... F22B 1/063 122/32

(Continued)

FOREIGN PATENT DOCUMENTS

DE 102009036064 A1 2/2011
DE 102011007370 A1 10/2012

(Continued)

OTHER PUBLICATIONS

International Search Report and Written Opinion issued in connection with correponding PCT application No. PCT/EP2016/058462 dated Jul. 8, 2016.

*Primary Examiner* — Nathaniel Herzfeld
(74) *Attorney, Agent, or Firm* — Dority & Manning, P.A.

(57) ABSTRACT

An advanced molten salt once-through steam generator system functional on hot molten salt supplied via a supply line. The system includes a steam generator, a feedwater supply line, at least one high pressure heaters and a separator. The molten salt is supplied the steam generator, which includes at least one economizer, an evaporator, and a superheater to utilize the heat of the molten salt flowing from the superheater to economizer to generate steam. The feedwater line supplies the feedwater to the steam generator, flowing from the economizer to the superheater to be converted into steam by the hot molten salt. The heaters are arranged in series in the feedwater line to heat the feedwater up to required temperature. The separator enables separation of the water and steam.

9 Claims, 3 Drawing Sheets

(56) References Cited

U.S. PATENT DOCUMENTS 3,662,718 A * 5/1972 Creek ..... F22B 1/063 122/32
3,868,994 A * 3/1975 Petrek ..... F22B 1/063 122/32
4,061,533 A * 12/1977 Durrant ..... G21D 3/08 376/211
4,091,864 A * 5/1978 Cocuzza ..... C09K 5/16 126/263.01
4,205,633 A * 6/1980 Wittchow ..... F22B 35/101 122/406.4
4,261,301 A * 4/1981 Losel ..... F22B 29/12 122/406.4
4,287,430 A * 9/1981 Guido ..... F01K 3/22 290/40 C
4,430,962 A * 2/1984 Miszak ..... F22B 29/12 122/406.4
4,619,809 A * 10/1986 Schluderberg ..... F01K 3/181 376/402
5,307,802 A * 5/1994 Placek ..... F22B 1/06 126/600
2007/0283906 A1* 12/2007 Albrecht ..... F22B 29/04 122/406.1
2012/0272649 A1* 11/2012 Berndt ..... F01K 7/22 60/645
2013/0186089 A1* 7/2013 Bruckner ..... F01K 7/22 60/641.11
2014/0014189 A1* 1/2014 Brodesser ..... F22B 29/12 137/11
2014/0202156 A1* 7/2014 Clement ..... F22B 1/006 60/649
2014/0262257 A1* 9/2014 Costanzo ..... F22D 1/02 166/272.3
2015/0240792 A1* 8/2015 Ehrsam ..... F03G 6/067 60/641.8

FOREIGN PATENT DOCUMENTS

WO 2009034577 A2 3/2009
WO 2011124408 A2 10/2011

* cited by examiner

MOLTEN SALT ONCE-THROUGH STEAM GENERATOR

BACKGROUND

The present disclosure generally relates to the field of steam generator, and, more particularly, to an advanced molten salt once-through steam generator for solar thermal power plants.

Solar thermal power plants with molten salt have been introduced to the market focusing on base load operations. Such power plants are equipped with standard drum-type steam generator.

For example, in a conventional arrangement as depicted in FIG. 1, a steam generator 10 includes a superheater 11, an evaporator 12, an economizer 13, a reheater 14, and a steam drum 16, which are fluidically connected to receive feedwater from a feedwater source 18, which may be heated via a high presser heater 15, flowing from the economizer 13 to the superheater 11 to produce steam by using the heat of molten salt 'MS' flowing from the superheater 11 to the economizer 13. Further, in such conventional arrangement of the steam generator 10 with the steam drum 16, a recirculation line 19 of the feedwater from the economizer 13 outlet to the economizer 13 inlet, and, an economizer bypass 20, are included to work at high pressure, nearly 170 bar, in nominal load, and to maintain the feedwater inlet temperature to at least 245° C. at the same time and in full load and part load operation conditions to obtain efficient thermodynamics cycle and avoiding Molten Salt freezing at the economizer 13 inlet.

However, in upcoming years, more flexible power plants will be required, which may have to be suitable for fast load changes. In such a scenario, the conventional steam generator 10 with steam drum 16 may not be suitable to effectively accommodate with the power plant needs. This is due to presence of steam drum 16 in the steam generator 10 that reduces the flexibility the steam production depending upon the quick changes as per the load of the power plant. In addition to this, the recirculation line 19 and the economizer bypass 20 which are required to operate the steam generator 10 with steam drum 16 also increases the complexity.

Further, there are available other types of steam generators that do not include steam drum, such as, once-through steam generator (OTSG). The absence of steam drum may be suitable for quick changes in steam production and fewer variables to control. However, such OTSG are only ideal for cycling and base load operation and may not be equally suitable to be used with molten salt solar power plants due to temperature and pressure requirements of the feedwater, i.e. 170 bars and 245° C. Furthermore, use of the recirculation line and the economizer bypass as it is in the conventional steam drum 10, to maintain the parameter of the feedwater, in OTSG may be not suitable with molten salt due to removal of steam drum.

Accordingly, there exist a need to overcome the existing problem in the OTSG to make it suitable to be incorporated in a solar thermal power plant to enable thereto to fast load changes, suitability to frequent start-up and shut-down, suitability for producing steam at high temperature and pressure, and decrease water consumption along with weight reduction and compact integration.

SUMMARY

The present disclosure discloses an advanced molten salt once-through steam generator (OTSG) system that will be presented in the following simplified summary to provide a basic understanding of one or more aspects of the disclosure that are intended to overcome the discussed drawbacks, but to include all advantages thereof, along with providing some additional advantages. This summary is not an extensive overview of the disclosure. It is intended to neither identify key or critical elements of the disclosure, nor to delineate the scope of the present disclosure. Rather, the sole purpose of this summary is to present some concepts of the disclosure, its aspects and advantages in a simplified form as a prelude to the more detailed description that is presented hereinafter.

An object of the present disclosure is to describe an advanced molten salt once-through steam generator for being incorporated in a solar thermal power plant to enable thereto to fast load changes, suitability to frequent start-up and shut-down, suitability for producing steam at high temperature and pressure, and decrease water consumption along with weight reduction and compact integration.

In one aspect of the present disclosure, an advanced molten salt once-through steam generator system functional on hot molten salt supplied via a supply line is provided. The advanced molten salt once-through steam generator system includes a steam generator arrangement, a feedwater supply line, at least one high pressure heater, a separator and a bypass line. The steam generator arrangement includes a shell to accommodate non-segmented sections of at least one economizer, an evaporator, and a superheater fluidically and continuously configured to each other to directly utilize the heat of the hot molten salt flowing from the superheater to economizer to generate steam. In one embodiment, the steam generator arrangement may also include a reheater in fluid communication. Further, the feedwater supply line is configured to supply the feedwater from a feedwater source to the steam generator arrangement, flowing from the economizer to the superheater to utilize the heat of the hot molten salt to be converted in to the steam. The high pressure heaters, i.e. first and second high pressure heaters, are arranged in series and configured in the feedwater supply line between the feedwater source and the steam generator arrangement to heat the feedwater up to required temperature. The separator is fluidically configured between the steam generator arrangement and the feedwater supply line to enable separation of the water and steam received from the evaporator to supply steam to the superheater and water to the feedwater supply line. Moreover, the bypass line is configured to bypass at least one high pressure heater to control the feed water inlet temperature flowing to the steam generator system so as to control the molten salt outlet temperature of steam generator at same time.

In an embodiment, the bypass line is adapted to bypass the high pressure heater directly upstream of the steam generator system, in this case the second high pressure heater.

In an alternative embodiment of the present disclosure, the system may include at least one controlled turbine extraction line to control the heat load of at least one high pressure heater, respectively, to control the feed water inlet temperature flowing to the steam generator system so as to control the molten salt outlet temperature of steam generator at same time.

In an embodiment, the system may further include an additional economizer in fluid communication with the economizer and the feedwater supply line.

In an embodiment, the system may further include an additional feedwater supply line between the additional economizer and the feedwater supply line.

In an embodiment, the system may further include a recirculation line adapted to be configured between the additional economizer and the first and second high pressure heaters to recirculate the feed water from the additional economizer to the feedwater supply line.

These together with the other aspects of the present disclosure, along with the various features of novelty that characterize the present disclosure, are pointed out with particularity in the present disclosure. For a better understanding of the present disclosure, its operating advantages, and its uses, reference should be made to the accompanying drawings and descriptive matter in which there are illustrated exemplary embodiments of the present disclosure.

BRIEF DESCRIPTION OF THE DRAWINGS

The advantages and features of the present disclosure will better understood with reference to the following detailed description and claims taken in conjunction with the accompanying drawing, wherein like elements are identified with like symbols, and in which:

Like reference numerals refer to like parts throughout the description of several views of the drawings.

DETAILED DESCRIPTION

For a thorough understanding of the present disclosure, reference is to be made to the following detailed description, including the appended claims, in connection with the above-described drawings. In the following description, for purposes of explanation, numerous specific details are set forth in order to provide a thorough understanding of the present disclosure. It will be apparent, however, to one skilled in the art that the present disclosure can be practiced without these specific details. In other instances, structures and devices are shown in block diagrams form only, in order to avoid obscuring the disclosure. Reference in this specification to "one embodiment," "an embodiment," "another embodiment," "various embodiments," means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but may not be of other embodiment's requirement.

Although the following description contains many specifics for the purposes of illustration, anyone skilled in the art will appreciate that many variations and/or alterations to these details are within the scope of the present disclosure. Similarly, although many of the features of the present disclosure are described in terms of each other, or in conjunction with each other, one skilled in the art will appreciate that many of these features can be provided independently of other features. Accordingly, this description of the present disclosure is set forth without any loss of generality to, and without imposing limitations upon, the present disclosure. Further, the relative terms, such as "first," "second" and the like, herein do not denote any order, elevation or importance, but rather are used to distinguish one element from another. Further, the terms "a," "an," and "plurality" herein do not denote a limitation of quantity, but rather denote the presence of at least one of the referenced item.

Figure 2:
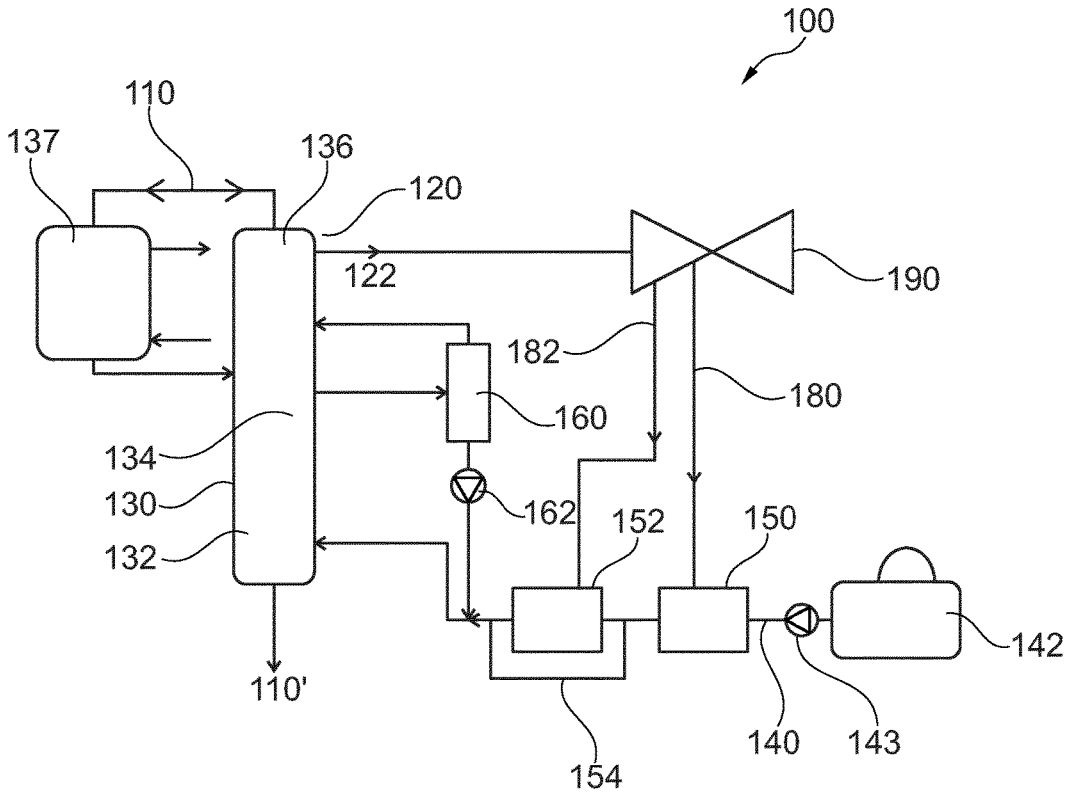
FIG. 2 is a diagrammatic illustration of an advanced molten salt once-through steam generator system, in accordance with one exemplary embodiment of the present disclosure.

Referring to FIG. 2, an example diagrammatic illustration of an advanced molten salt once-through steam generator system 100 is depicted in accordance with an exemplary embodiment of the present disclosure. The an advanced molten salt once-through steam generator system 100 (hereinafter referred to as 'system 100') may be configured in a solar power plant that includes and utilizes a molten salt, e.g. a mixture of Sodium and Potassium Nitrates ($NaNO_3$ and $KNO_3$) to be heated in a solar receiver placed on a tower of substantial height and surrounded by a large field of heliostats to focus sunlight on the solar receiver. In the arrangement of the system 100, the molten salt may be a medium used to transfer heat, however, without departing from the scope of the present disclosure, any other thermal storage fluid, such as thermal oil/thermic fluid, may be used as found suitable for the said purpose.

Figure 3:
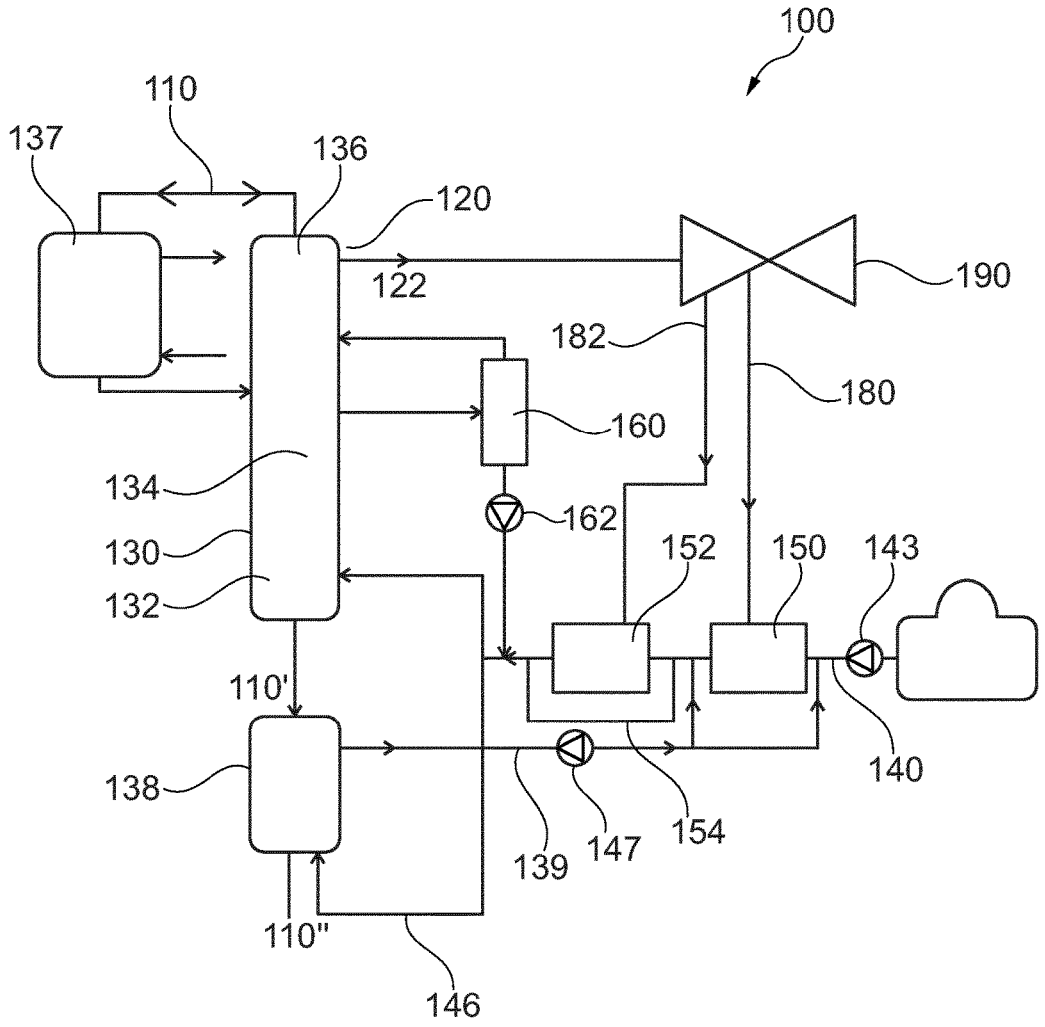
FIG. 3 is a diagrammatic illustration of an advanced molten salt once-through steam generator system, in accordance with another exemplary embodiment of the present disclosure.

In as much as the construction and arrangement of the system 100, various associated elements may be well-known to those skilled in the art, it is not deemed necessary for purposes of acquiring an understanding of the present disclosure that there be recited herein all of the constructional details and explanation thereof. Rather, it is deemed sufficient to simply note that as shown in FIGS. 2 and 3, in the system 100, only those components are shown that are relevant for the description of various embodiments of the present disclosure.

As depicted in FIG. 2, the system 100 is adapted to be functional on hot molten salt supplied via a molten salt supply 110. The system 100 includes a steam generator arrangement 120, a feedwater supply line 140, at least one high pressure heater, i.e. a first high pressure heater 150 and a second high pressure heater 152, and a separator 160. In the arrangement of the system 100, there are shown only two high pressure heaters 150, 152, however without departing from the scope of the present disclosure, the system 100 is capable of accommodating more than two such high pressure heaters as per the requirement thereof. In any manner, the system 100 shall not be considered limited to include only two such high pressure heaters.

The molten salt supply 110 is adapted to supply hot molten salt to the steam generator arrangement 120 (hereinafter referred to as 'steam generator 120'). The steam generator 120 includes a shell 130 to accommodate non-segmented sections of at least one economizer 132, an evaporator 134, and a superheater 136 fluidically and continuously configured to each other. The hot molten salt from the molten salt supply 110 is adapted to be directly supplied to the steam generator 110 flowing from the superheater 136 to economizer 132. In an embodiment, the steam generator 120 includes a reheater 137 in fluid communication with the molten salt supply 110. The molten salt may also be supplied to the steam generator 120, through the reheater 137, to generate pressure steam, for example, intermediate pressure steam, to supply to an intermediate pressure turbine in an arrangement of multi-stage turbine. The reheat assembly 137, in the arrangement of the multi-stage turbine, may also be utilized to reheat pressure steam received from the turbine stage downstream of the high pressure turbine by the hot molten salt.

Further, the feedwater supply line 140 is fluidically configured to the steam generator arrangement 120. The feedwater supply line 140 is configured to supply the feedwater from a feedwater source 142 via a pump 143 to the steam generator arrangement 120. The feedwater from the feedwater supply line 140 is adapted to flow in the steam generator 120 from the economizer 132 to the superheater 136.

The heat of the molten salt flowing from the superheater 136 to economizer 132 is utilized by the feedwater flowing from the economizer 132 to the superheater 136 to obtain steam to be utilised by the turbines or multi-stage turbines for producing electricity.

Furthermore, at least one high pressure heaters, in this embodiment two such high pressure heaters, i.e. the first and second high pressure heaters 150, 152 are arranged in series and configured in the feedwater supply line 140 between the feedwater source 142 and the steam generator arrangement 130 to heat the feedwater up to required temperature, for example, at about 245° C. or above this temperature at all load conditions of the power plant.

Further, the system 100 may include a bypass line 154 adapted to bypass at least one of the high pressure heater 150, 152, to control the feed water inlet temperature flowing to the steam generator system 120 so as to control the molten salt outlet temperature of steam generator 120 at same time. For example, the bypass line 154 is adapted to bypass the high pressure heater 152 directly upstream of the steam generator system 120, in case, if the required temperature is achieved by the first high pressure heaters 150.

Figure 1:
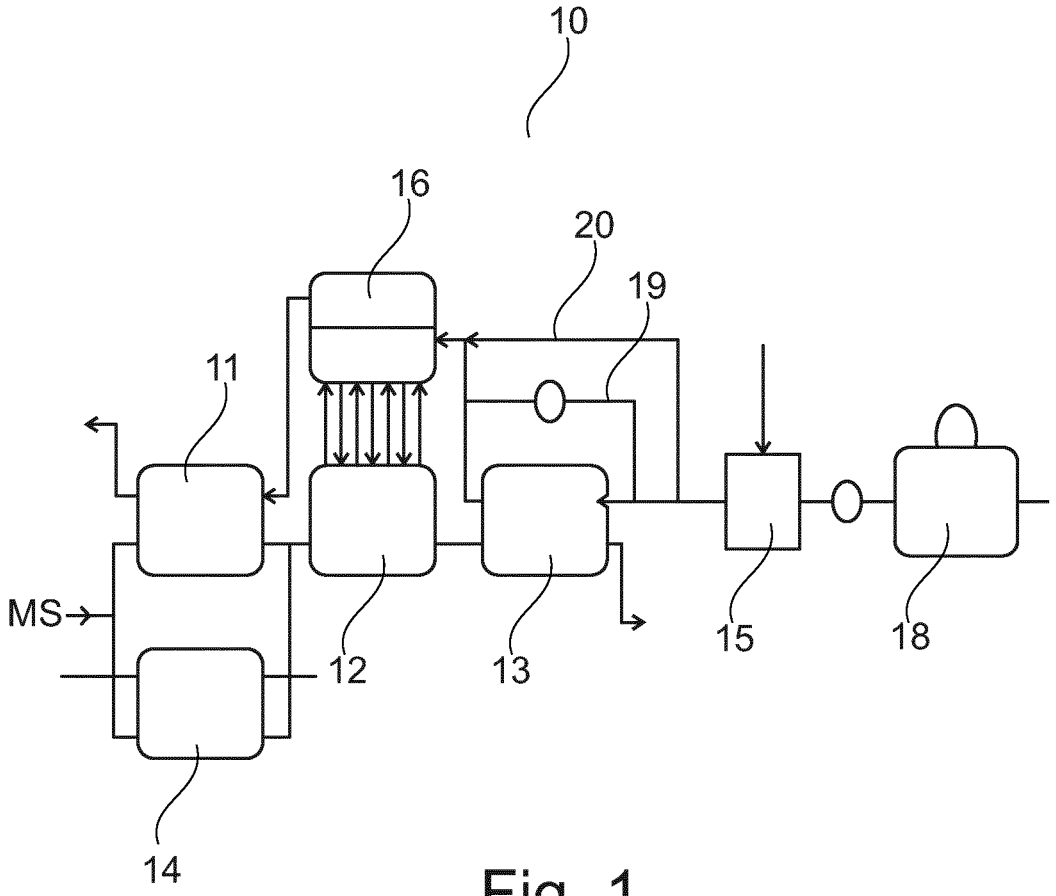
Fig. 1 Prior Art
FIG. 1 illustrates a conventional design of a steam generation arrangement.

Moreover, the separator 160 may be fluidically configured between the steam generator arrangement 130 and the feedwater supply line 140 to enable separation of the water and steam received from the evaporator 134 to supply steam to the superheater 136 and water to the feedwater supply line 140 by a pump 162. The separator 160 effectively accommodates water separation from the steam in the steam generator 120 and sends it back to the feedwater supply line 140, which effectively replaces the requirement of steam drum as required in the conventional design, as shown in FIG. 1. The high pressure steam exits from the steam generator 120 at 122 to a turbine 190.

Alternatively, the system 100, instead of the bypass line 154 as described above, may include at least one controlled turbine extraction line 180, 182 from the turbine 190. The controlled turbine extraction lines 180, 182 may, similar to the bypass line 154, control the heat load of at least one high pressure heater 150, 152, respectively, to control the feed water inlet temperature flowing to the steam generator system 120 so as to control the molten salt outlet temperature of steam generator 120 at same time.

The bypass line 154 and the at least one controlled turbine extraction lines 180, 182 may be selectively used at a time to achieve to control the feed water inlet temperature and the molten salt outlet temperature of steam generator 120 at same time.

As compared to the conventional steam turbine shown in prior art FIG. 1, an embodiment of the present invention replaces the steam drum 16 and the recirculation line 19. With the removal of the steam drum 16 and the recirculation line 19, it is nearly impossible to maintain the molten salt temperature of about 290° C. at the economizer 132 of an embodiment of the present invention, if the pressure is kept at 170 bars.

However, with an arrangement of the present invention, such target may nearly be achieved by enabling the molten salt temperature at about 295° C. at the economizer 132, as per one embodiment of the present disclosure.

As per the said embodiment, in an example operational explanation of FIG. 2, the feed water at about 180° C., from the feedwater source 142, is supplied via the feedwater supply line 140. The first and second high pressure heaters 150, 152 are adapted in the feedwater supply line 140 to maintain the mass flow rate and heat of the feedwater to about 245° C. depending upon the load conditions of the power plant and maintain the molten salt outlet temperature of steam generator 120 at same time.

Alternatively, the extraction lines 180, 182 can also be used to control the feed water inlet temperature and the molten salt outlet temperature of steam generator 120 at same time.

In this case, when using the first and second high pressure heaters 150, 152 instead of the extraction lines 180, 182, the temperature requirement of about 245° C. of the feedwater, is achieved by only the first high pressure heater 150, and therefore, the second high pressure heaters 152 may be bypassed via the 154 to supply the feedwater at such temperature to the steam generator 120. For example, during the full load conditions of the power plant, the feedwater is bypassed from the second high pressure heater 152 via the bypass line 154. Further, the mass flow rate is controlled to maintain the inlet temperature of the economizer 132 of about 245° C. The mass flow rate in the bypass is reduced in part load condition of the power plant to keep at least the desired feedwater temperature. The steam generator 120 receives heat of the hot molten salt to convert the feedwater into steam. The hot molten salt at about 565° C. is adapted to flow from the superheater 136 to economizer 132, which converts the feedwater flowing from the economizer 132 to the superheater 136 into high pressure steam at pressure of about 170 bars, and temperature of about 550° C. The high pressure steam exits from the steam generator 120 at 122 to the turbine 190. The separator 160 and the reheater 137 may perform as described above. The molten salt which loses its heat to the feedwater and exits at 110' from the evaporator 132 of the steam generator 120 at about 295° C.

The extraction lines 180, 182 can also be used to control the feed water inlet temperature and the molten salt outlet temperature of steam generator 120 at same time in a similar manner as that of high pressure heaters 150, 152 and the bypass 154 combination.

Normally, cold molten salt are required to be stored at temperature of about 290° C. Therefore, if the temperature of about 295° C. may not be acceptable at times and required to be reduced.

For that, in an embodiment, as shown in FIG. 3, the system 100 may further include an additional economizer 138, an additional feedwater supply line 146, and a recirculation line 139. The additional economizer 138 is fluidically connected with the economizer 132 and the feedwater supply line 140. In an embodiment, the additional economizer 138 may be the part of the same shell 130 as the first economizer 134.

In such embodiment, the additional feedwater supply line 146 is configured between the additional economizer 138 and the feedwater supply line 140. Further, the recirculation line 139 is configured between the additional economizer 138 and the first and second high pressure heaters 150, 152 to recirculate the feed water from the additional economizer 138 to the high pressure heaters 150, 152 via a pump 147 to maintain the temperature of the molten salt at about 290° C., the temperature thereof if not acceptable at about 295° C.

In operation, per FIG. 3, the additional economizer 138 is configured to the system 100 as explained above. The molten salt at temperature of about 290° C. is adapted to flow from the additional economizer 138. Further, the additional feedwater supply line 146 at the same times is configured to supply feedwater at temperature of about 245° C. to cool the molten salt, and that exit from the economizer 138 at 110" is at about 290° C. Upon cooling the molten salt at required temperature, the feedwater at about 290° C. is recirculated back via recirculation line 139 to the high pressure heaters 150, 152, where it retain its normal temperature of about 245° C. As described, the extraction lines 180, 182 can also be used to control the feed water inlet temperature and the molten salt outlet temperature of steam generator 120 at same time.

The system 100 of the present disclosure is advantageous in various scopes such as described above. The present steam generator system eliminates the requirement of the steam drum and at still makes it suitable to be incorporated in a solar thermal power plant to enable thereto to fast load changes, suitability to frequent start-up and shut-down, suitability for producing steam at high temperature and pressure, and decrease water consumption along with weight reduction and compact integration.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present disclosure.

What is claimed is:

1. A molten salt once-through steam generator system functional on hot molten salt supplied via a supply line, comprising:

a steam generator arrangement having a shell to accommodate non-segmented sections of a first economizer, an evaporator, and a superheater fluidically configured to each other, wherein the steam generator arrangement utilizes heat of the molten salt flowing from the superheater to the first economizer to generate steam;

a feedwater supply line configured to supply the feedwater from a feedwater source to the steam generator arrangement, flowing from the first economizer to the superheater to utilize the heat of the molten salt to be converted into the steam;

at least two high pressure heaters configured in the feedwater supply line between the feedwater source and the steam generator arrangement;

a separator fluidically configured between the steam generator arrangement and the feedwater supply line; and a bypass line to bypass at least one of the at least two high pressure heaters to control the feed water inlet temperature flowing to the steam generator arrangement so as to control the molten salt outlet temperature of the steam generator arrangement at the same time.

2. The molten salt once-through steam generator as claimed in claim 1, wherein the bypass line is adapted to bypass the high pressure heater directly upstream of the steam generator arrangement.

3. The molten salt once-through steam generator as claimed in claim 1, further comprising at least one controlled turbine extraction line to control the heat load of the at least two high pressure heaters, respectively, to control the feed water inlet temperature flowing to the steam generator arrangement so as to control the molten salt outlet temperature of the steam generator arrangement at the same time.

4. The molten salt once-through steam generator system as claimed in claim 1, further comprising a reheater fluidically configured with the steam generator arrangement.

5. The molten salt once-through steam generator system as claimed in claim 1, further comprising a second economizer in fluid communication with the first economizer and the feedwater supply line.

6. The molten salt once-through steam generator system as claimed in claim 5, further comprising an additional feedwater supply line between the second economizer and the feedwater supply line.

7. The molten salt once-through steam generator system as claimed in claim 5, further comprising a recirculation line, configured between the second economizer and the at least two high pressure heaters, to recirculate the feed water from the second economizer to the feedwater supply line.

8. The molten salt once-through steam generator system as claimed in claim 1, wherein the evaporator is disposed downstream of the superheater, and the first economizer is disposed downstream of the evaporator with respect to a flow of the molten salt.

9. A molten salt once-through steam generator system functional on hot molten salt supplied via a supply line, comprising:

a steam generator arrangement having a shell to accommodate non-segmented sections of a first economizer, an evaporator, and a superheater fluidically configured to each other, wherein the steam generator arrangement utilizes heat of the molten salt flowing from the superheater to the first economizer to generate steam;

a feedwater supply line configured to supply the feedwater from a feedwater source to the steam generator arrangement, flowing from the first economizer to the superheater to utilize the heat of the molten salt to be converted into the steam;

at least two high pressure heaters configured in the feedwater supply line between the feedwater source and the steam generator arrangement;

a separator fluidically configured between the steam generator arrangement and the feedwater supply line; and at least one controlled turbine extraction line to control the heat load of the at least two high pressure heaters, respectively, to control the feed water inlet temperature flowing to the steam generator arrangement so as to control the molten salt outlet temperature of the steam generator arrangement at the same time.

* * * * *